US009746147B2

(12) United States Patent
Benner

(10) Patent No.: US 9,746,147 B2
(45) Date of Patent: Aug. 29, 2017

(54) LIGHT FIXTURE WITH COMMUNICATION OR POWER CONNECTOR

(71) Applicant: McKeon Products, Inc., Warren, MI (US)

(72) Inventor: Devin Benner, Pleasant Ridge, MI (US)

(73) Assignee: McKeon Products, Inc., Warren, MI (US)

( * ) Notice: Subject to any disclaimer, the term of this patent is extended or adjusted under 35 U.S.C. 154(b) by 0 days.

(21) Appl. No.: 14/997,790

(22) Filed: Jan. 18, 2016

(65) Prior Publication Data

US 2016/0131319 A1 May 12, 2016

Related U.S. Application Data

(62) Division of application No. 13/896,018, filed on May 16, 2013, now Pat. No. 9,267,653.

(51) Int. Cl.

| | |
|---|---|
| ***F21S 8/06*** | (2006.01) |
| ***F21S 8/02*** | (2006.01) |
| ***F21V 33/00*** | (2006.01) |
| ***F21S 8/00*** | (2006.01) |
| ***F21V 21/14*** | (2006.01) |

(Continued)

(52) U.S. Cl.

CPC ..... *F21S 8/063* (2013.01); *F21S 8/026* (2013.01); *F21S 8/036* (2013.01); *F21S 8/065* (2013.01); *F21V 21/14* (2013.01); *F21V 21/22* (2013.01); *F21V 33/006* (2013.01); *F21V 33/0096* (2013.01); *H01R 33/92* (2013.01); *F21V 21/15* (2013.01); *H01R 13/447* (2013.01); *H01R 2103/00* (2013.01)

(58) Field of Classification Search

CPC ..... F21S 8/063; F21S 8/026; F21V 21/22

See application file for complete search history.

(56) References Cited

U.S. PATENT DOCUMENTS

| | | | |
|---|---|---|---|
| 6,888,315 | B1 | 5/2005 | Hsiao |
| 7,060,040 | B2 | 6/2006 | Farmer |

(Continued)

FOREIGN PATENT DOCUMENTS

| | | | |
|---|---|---|---|
| CN | 2628857 | Y | 7/2004 |
| CN | 201037638 | Y | 3/2008 |

(Continued)

*Primary Examiner* — Andrew Coughlin
*Assistant Examiner* — Christopher E Dunay
(74) *Attorney, Agent, or Firm* — Honigman Miller Schwartz and Cohn LLP

(57) ABSTRACT

A light fixture includes a fixture body having a mount, a mounting stem, and a receiver. The mount is configured to mount onto a ceiling surface and suspend the fixture body. The mounting stem has a first end connected to the mount and a second end. The receiver is disposed on the second end of the mounting stem below the first end with respect to the ceiling surface. The light fixture includes a socket disposed on the receiver for receiving a light emitter and a frame having a first end connected to the fixture body and extending downward and away from the fixture body with respect to the ceiling surface to a second end located below the received light emitter. A power receptacle and/or a communication receptacle is/are disposed on the frame in a location below the fixture body and the received light emitter with respect to the ceiling surface.

9 Claims, 17 Drawing Sheets

(51) Int. Cl.

| | |
|---|---|
| ***F21V 21/22*** | (2006.01) |
| ***H01R 33/92*** | (2006.01) |
| *F21V 21/15* | (2006.01) |
| *H01R 103/00* | (2006.01) |
| *H01R 13/447* | (2006.01) |

(56) References Cited

U.S. PATENT DOCUMENTS

| | | | | |
|---|---|---|---|---|
| 7,527,600 | B2 | 5/2009 | Farmer | |
| 7,736,033 | B2 | 6/2010 | Patel | |
| 2003/0227770 | A1 | 12/2003 | Chen et al. | |
| 2004/0012344 | A1 | 1/2004 | Bibi | |
| 2010/0321939 | A1* | 12/2010 | Patel | F21S 6/002 362/253 |
| 2011/0305056 | A1 | 12/2011 | Chien | |
| 2013/0039049 | A1* | 2/2013 | Jones | F21L 14/04 362/184 |
| 2013/0322061 | A1* | 12/2013 | Carpenter | F21S 6/00 362/123 |
| 2014/0268743 | A1* | 9/2014 | Park | F21V 7/00 362/235 |
| 2014/0268816 | A1* | 9/2014 | Ricci | F21S 8/063 362/311.13 |
| 2015/0292714 | A1* | 10/2015 | Castillo | F21V 13/04 362/147 |
| 2015/0377432 | A1* | 12/2015 | Scales | F21S 8/043 362/147 |

FOREIGN PATENT DOCUMENTS

| | | | |
|---|---|---|---|
| CN | 201439918 | U | 4/2010 |
| CN | 201462558 | U | 5/2010 |
| CN | 201462559 | U | 5/2010 |
| CN | 201875530 | U | 6/2011 |
| CN | 201909262 | U | 7/2011 |
| CN | 201973555 | U | 9/2011 |
| CN | 202024171 | U | 11/2011 |
| CN | 202065766 | U | 12/2011 |
| CN | 202203752 | U | 4/2012 |
| CN | 202432337 | U | 9/2012 |

* cited by examiner

LIGHT FIXTURE WITH COMMUNICATION OR POWER CONNECTOR

CROSS REFERENCE TO RELATED APPLICATIONS

This U.S. patent application is a divisional of, and claims priority under 35 U.S.C. §121 from, U.S. patent application Ser. No. 13/896,018, filed on May 16, 2013, which is hereby incorporated by reference in its entirety.

TECHNICAL FIELD

This disclosure relates to light fixtures having a communication or power connector.

BACKGROUND

Portable electronic devices such as smart phones, tablets, and laptops have become popular in recent years. For example, one person may have a portable music recording device, a portable smartphone, a portable tablet, and a portable laptop. These portable electronics are usually powered by batteries and may be used in battery mode or when the device is plugged-in a power supply (e.g., a wall outlet or another portable electronic device. In addition, most of the batteries of these devices can be recharged using an adapter cord or a plug-in charging unit having a unique plug that connects to a receptacle that is unique to a specific portable device or manufacturer.

When a person is charging the batteries of multiple portable devices the cords may get tangled and cluttered across a floor surface. In addition, the tangled and cluttered cords may cause a person to trip over the cords, potentially causing the device(s) to fall on the ground and break.

SUMMARY

One aspect of the disclosure provides a light fixture including a fixture body, a shroud and a power or communication receptacle. The fixture body is configured to support a light emitter. The shroud is disposed on the fixture body and is arranged to at least partially conceal the light emitter. Finally, the power or communication receptacle is disposed on the fixture body in a location at least partially concealed by the shroud.

Implementations of the disclosure may include one or more of the following features. In some implementations, the fixture body includes a socket for electric connection of the light emitter. The power or communication receptacle may be disposed adjacent the socket. Additionally, the power or communication connector may be positioned within between about 1 inch and about 3 inches from the socket. In some examples, the fixture body is configured for ceiling or wall mounting.

In some implementations, the fixture body includes a mounting stem, and a receiver. The mounting stem may have a first and a second end. The first end may be configured to mount onto a supporting surface. The receiver may be disposed on the 10 second end of the mounting stem. The receiver may include a socket for electric connection of the light emitter, and the power or communication receptacle. The light fixture may further include a receptacle cover disposed on the receiver. The receptacle cover moves between a closed position concealing the power or communication receptacle and an open position allowing access to the power or communication receptacle. The receptacle cover may include a pivoting door or a sliding door. Additionally or alternatively, the light fixture may include a pull-down mechanism. The pull-down mechanism has a first portion connected to the mounting stem or the receiver and a second portion moving with respect to the first portion between a closed position concealing the power or communication receptacle and an open position allowing access to the power or communication receptacle. The first and second portions of the pull-down mechanism may be arranged for telescopic movement.

Another aspect of the disclosure provides a light fixture having a base, a fixture body, a shroud, a power or communication receptacle, and a receptacle cover. The fixture body is disposed on the base and is configured to support a light emitter. The shroud is disposed on the fixture body and is arranged to at least partially conceal the light emitter. In addition, the power or communication receptacle is disposed on the fixture body away from the base. The receptacle cover is disposed on the fixture body and moves between a closed position concealing the power or communication receptacle and an open position allowing access to the power or communication receptacle. In some examples, the receptacle cover includes a pivoting door or a sliding door.

In some examples, the fixture body further includes a mounting stem, a receiver, and a frame. The receiver is disposed on the mounting stem and defining a socket for electric connection of the light emitter. The frame is connected to the receiver and supporting the power or communication receptacle spaced away from the socket by a threshold distance. The threshold distance may be at least three inches. The light fixture may further include a ball screw having first and second portions. The first portion of the ball screw is connected to the receiver and the second portion of the ball screw is connected to the frame. The frame may rotate with respect to the shroud about a vertical axis defined by the fixture body.

In some implementations, the light fixture further includes a connector body movably disposed on the fixture body and supporting the power or communication receptacle. The connector body moves between a closed position where the power or communication receptacle is concealed by the fixture body or shroud and an open position allowing access to the power or communication receptacle. A pull-down mechanism may also be included in the light fixture. The pull-down mechanism has a first portion connected to the connector body and a second portion moving with respect to the first portion between a closed position concealing the power or communication receptacle and an open position allowing access to the power or communication receptacle. In some examples, the connector body rotates with respect to the shroud about a vertical axis defined by the fixture body to allow access to the power or communication receptacle. The connector body may rotate with respect to the shroud about a horizontal axis defined by the fixture body to allow access to the power or communication receptacle.

In yet another aspect of the disclosure, a light fixture includes a mount, a stem, a power or communication receptacle, at least one arm, and a light receiver. The stem has a first end attached to the mount and extends away from the mount to a second end. The power or communication receptacle is disposed on a second end of the stem. The at least one arm has a first end attached to the stem and extends away from the stem to a second end. In addition, the light receiver may be disposed on the second end of at least one arm for receiving a light emitter.

In some examples, the power or communication receptacle is releasably detachable from the fixture body. Additionally or alternatively, the light fixture may further include a receptacle cover disposed on the second end of the stem. The receptacle cover moves between a closed position concealing the power or communication receptacle and an open position allowing access to the power or communication receptacle. The receptacle cover may include a pivoting door or a sliding door.

In some implementation, the light fixture includes a connector body movably disposed on the second end of the stem. The connector body supports the power or communication receptacle and moves between a closed position where the power or communication receptacle is concealed by the fixture body or shroud and an open position allowing access to the power or communication receptacle.

In some examples, the light fixture includes a pull-down mechanism. The pull-down mechanism includes a first position connected to the connector body and a second portion moving with respect to the first portion between a closed position concealing the power or communication receptacle and an open position allowing access to the power or communication receptacle. The connector body may rotate with respect to the shroud about a vertical axis defined by the stem to allow access to the power or communication receptacle. In some examples, the connector body rotates with respect to the shroud about a horizontal axis defined by the stem to allow access to the power or communication receptacle. The first and second portions of the pull-down mechanism may be arranged for telescopic movement. Additionally or alternatively, the pull-down mechanism may include a ball screw having first and second portions, the first portion connecting to the connector body and the second portion connecting to the stem.

Another aspect of the disclosure provides a light fixture having a fixture body, a power or communication receptacle disposed on the fixture. The fixture body is configured to support a light emitter and includes a socket for electric connection of the light emitter. The power or communication connector is positioned within between about 1 inch and about 3 inches from the socket.

The fixture body may include a mounting stem and a receiver. The mounting stem may have first and second ends where the first end is configured to mount onto a supporting surface. The receiver is disposed on the second end of the mounting stem and supports the socket and the power and communication receptacle. In some examples, the light fixture further includes a receptacle cover disposed on the receiver. The receptacle cover moves between a closed position that conceals the power or communication receptacle and an open position that allows access to the power or communication receptacle. Additionally or alternatively, the fixture may include a connector body movably disposed on the fixture body. The connector body may support the power or communication receptacle and moves between a closed position and an open position. The closed position is when the power or communication receptacle is concealed by the fixture body or shroud and the open position is when access to the power or communication receptacle is allowed. Additionally, the fixture may include a pull-down mechanism having a first portion connected to the mounting stem or the receiver and a second portion moving with respect to the first portion between a closed position concealing the power or communication receptacle and an open position allowing access to the power or communication receptacle. The first and second portions of the pull-down mechanism may be arranged for telescopic movement. In some examples, the pull-down mechanism includes a ball screw having first and second portions where the first portion connects to the connector body and the second portion connects to the stem. A receptacle cover may be disposed on the second end of the stem and moves between a closed position concealing the power or communication receptacle and an open position allowing access to the power or communication receptacle.

In some examples, the light fixture includes a connector body rotating with respect to the fixture body about a vertical or horizontal axis defined by the stem to allow access to the power or communication receptacle.

In yet another aspect of the disclosure, an electric connector module for a light or fan fixture includes a module body, a power or communication receptacle and an electric connector. The power or communication receptacle is disposed on the module body and the electric connector is disposed on the module body and arranged to releasably electrically connect the power or communication receptacle to a power or communication line of the light or fan fixture.

In some implementations, the module body is configured to support a light emitter and includes a socket for electric connection of the light emitter. The module body may include a mounting stem and a receiver. The mounting stem has first and second ends where the first end is configured to mount onto a supporting surface of the light or fan fixture. The receiver is disposed on the second end of the mounting stem and supports a socket and the power and communication receptacle.

The electric connector module may further include a pull-down mechanism. The pull-down mechanism has first and second portions. The first portion connectable to the light or fan fixture and a second portion moving with respect to the first portion between a retracted position concealing the power or communication receptacle and an extended position allowing access to the power or communication receptacle. The first and second portions of the pull-down mechanism may be arranged for telescopic movement.

In some implementations, a shroud is disposed on the module body and arranged to at least partially conceal a light emitter supported by the module body. The module body may include a socket for electric connection of the light emitter.

A receptacle cover may be disposed on the second end of the stem. The receptacle cover moves between a closed position to conceal the power or communication receptacle and an open position to allow access to the power or communication receptacle. The receptacle cover may include a pivoting door or a sliding door.

In some implementations, the module body includes first and second mounting stems, a receiver and a frame. The first mounting stem has first and second ends, where the first end is configured to mount onto a supporting surface of the light or fan fixture. The receiver is disposed on the second end of the mounting stem and supports a socket for electric connection of a light emitter. The second mounting stem has first and second ends, where the first end is configured to mount onto the receiver. The frame is disposed on the second end of the second mounting stem and supports the power and communication receptacle.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Owning multiple portable devices, such as laptops, tablets, and smartphones, increases the number of cords and chargers a person may use to charge the portable electronic devices. This multiplicity of cords leads to an increase in cord clutter and/or cord entanglement on the ground, which may lead to a person tripping over the cords.

Referring to FIGS. 1-10, to avoid cords laying on the ground, in some implementations, a light fixture 100 includes a fixture body 110 and a power or communication receptacle 146. The light fixture 100 may be a table lamp, a desk lamp, a chandelier, or other light emitting device. Moreover, the light fixture 100 may be fixed or moveable. In some examples, the light fixture 100 may be a balanced arm lamp, also known as a floating arm lamp, having an adjustable arm which folds for an increase in flexibility and movement. The light fixture 100 may be for indoor or outdoor use.

The power or communication receptacle 146 may be a power receptacle 146*a* or a communication receptacle 146*b* or may be both a power and communication receptacle, such as, but not limited to, a universal serial bus (USB) or a high-definition multimedia interface (HDMI). In some examples, the communication receptacle 146*b* is an Ethernet cable receiver.

The fixture body 110 is configured to support a light emitter 144. The light emitter 144 may be, but is not limited to, an incandescent light bulb, a fluorescent lamp or tube, a compact fluorescent lamp (CFL), or an LED lamp. An incandescent light bulb produces light with a filament wire that produces light when heated to a high temperature. An electric current passing through the wire causes the wire to be heater to the high temperature. Therefore, when a light switch connected to a light bulb is turned on, current passes through the filament wire and increases the temperature of the filament wire to high temperature creating light. A fluorescent lamp or tube is gas charged and contains mercury atoms that are excited when an electrical current passes through the lamp or tube. The excited mercury atoms produce short-wave ultraviolet light producing visible light. Fluorescent lamp or tube is more efficient in producing light than incandescent light bulbs. A compact fluorescent lamp is a fluorescent lamp or tube designed to mimic the size of an incandescent bulb and therefore replace incandescent bulbs. A light-emitting diode (LED) bulb uses light emitting diodes as the source of light. LED bulbs are initially more expensive than fluorescent and incandescent bulbs; however, the LED lights have a higher efficiency and last longer.

Figure 1B:
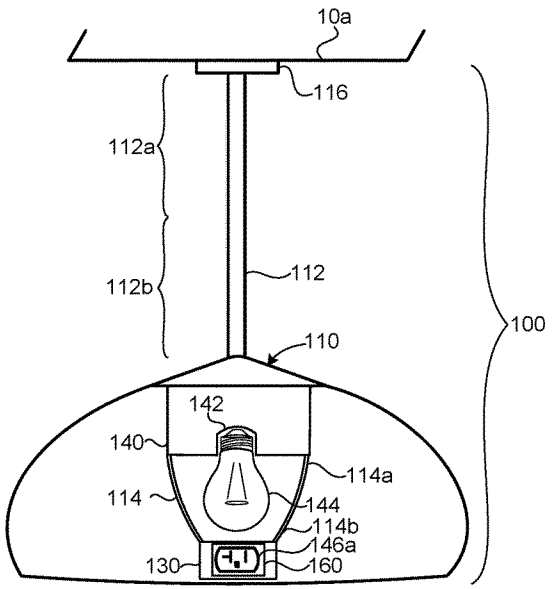
FIGS. 1A-1C are side views of exemplary light fixtures.
Figure 1A:
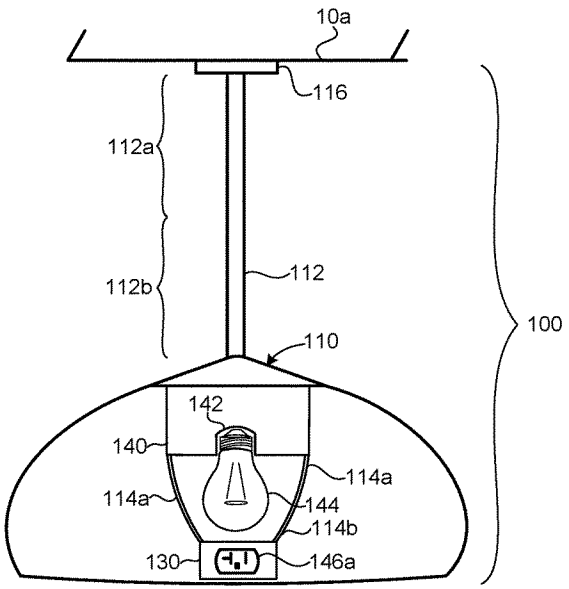
Figure 1C:
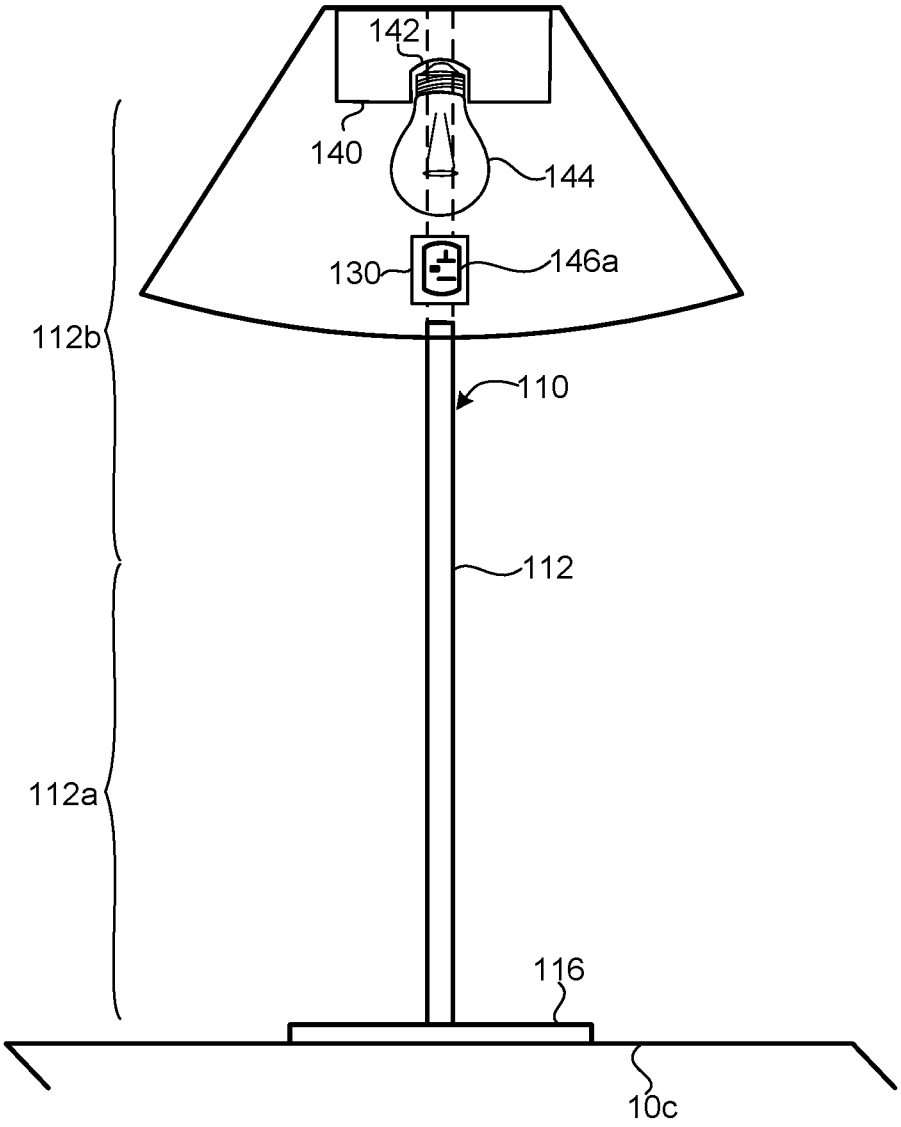

Referring to FIGS. 1A-1C, in some examples, the light fixture 100 includes a shroud 120. The shroud 120 may be disposed on the fixture body 110 and may be arranged to at least partially conceal the light emitter 144. The power or communication receptacle 146 is disposed on the fixture body 110 in a location at least partially concealed by the shroud 120 to maintain the aesthetic design of the light fixture 100. As shown, the shroud 120 has a conical shape allowing access to the power or communication receptacle 146; however, the shroud 120 may be of any shape.

In some implementations, the fixture body 110 includes a socket 142 or electric connection 142 of the light emitter 144. The power or communication receptacle 146 may be disposed adjacent the socket 142. In some examples, the fixture body 110 includes more than one socket 142 to receive more than one light emitter 144. Additionally, the power or communication connector 146 may be positioned near or separated from the socket 142. In some examples, the power or communication connector 146 is within between about 1 inch and about 3 inches from the socket 142. In some examples, the fixture body 110 is configured for ceiling 10*a* or wall 10*b* mounting, as shown in FIGS. 1A and 1B, or a standing light fixture on a floor 10*c*, as shown in FIG. 1C.

In some implementations, the fixture body 110 includes a mounting stem 112, and a receiver 140. The mounting stem 112 may be one or a combination of a cord, a chain, or a metal chain. The mounting stem 112 may have a first end 112*a* and a second end 112*b*. The first end 112*a* may be configured to mount onto a supporting surface 116. The supporting surface 116 may be a base for connecting the light fixture 100 to the ceiling 10*a*.

In some examples, the receiver 140 is disposed on the second end 112*b* of the mounting stem 112. The receiver 140 may include the socket 142 for electric connection of the light emitter 144 and the power or communication receptacle 146.

As shown in FIGS. 1A and 1B, the fixture body 110 includes a frame 130 for supporting the power and or communication receptacles 146. The frame 130 is connected to a frame stem 114 having a first end 114*a* attached to the receiver 140 and a second end 114*b* attached to the frame 130. As shown in FIG. 1C, the power or communication receptacle 146 may be mounted on a frame 130 disposed on the second end 112*b* of the mounting stem 112.

Referring back to FIG. 1B, the light fixture 100 may further include a receptacle cover 160 disposed on the receiver 140 or the frame 130. The receptacle cover 160 moves between a closed position concealing the power or communication receptacle 146 and an open position allowing access to the power or communication receptacle 146. The receptacle cover 160 may include a pivoting door or a sliding door (not shown).

Figure 2B:
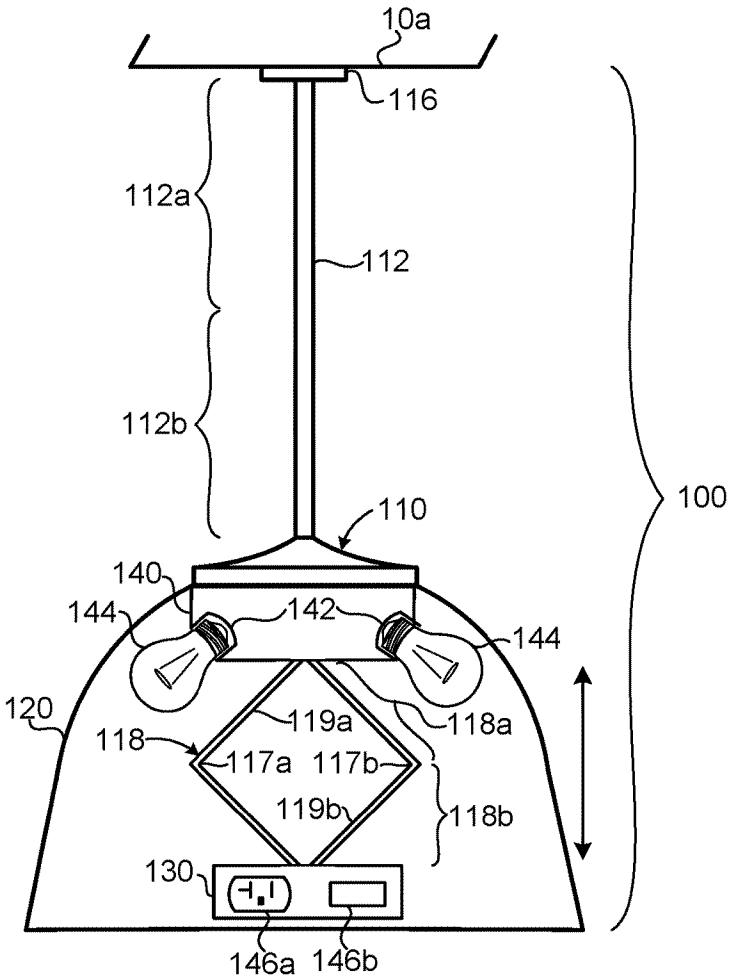
FIG. 2B is a side view of the light fixture of FIG. 2A in an open position.
Figure 2A:
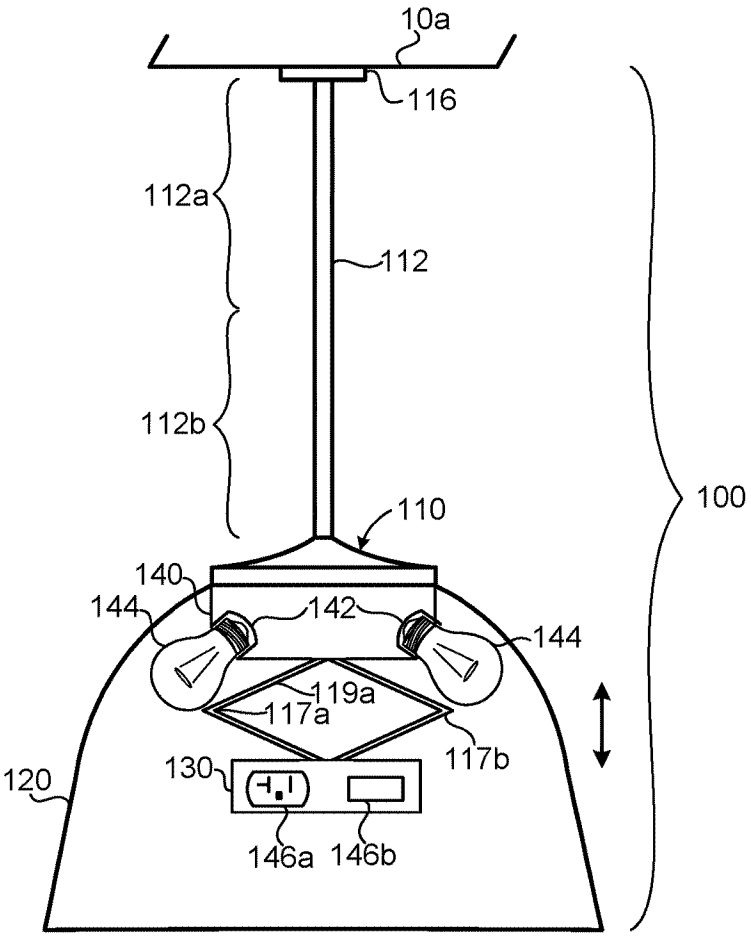
FIG. 2A is a side view of an exemplary light fixture having a pull-down mechanism in a closed position.
Figure 3A:
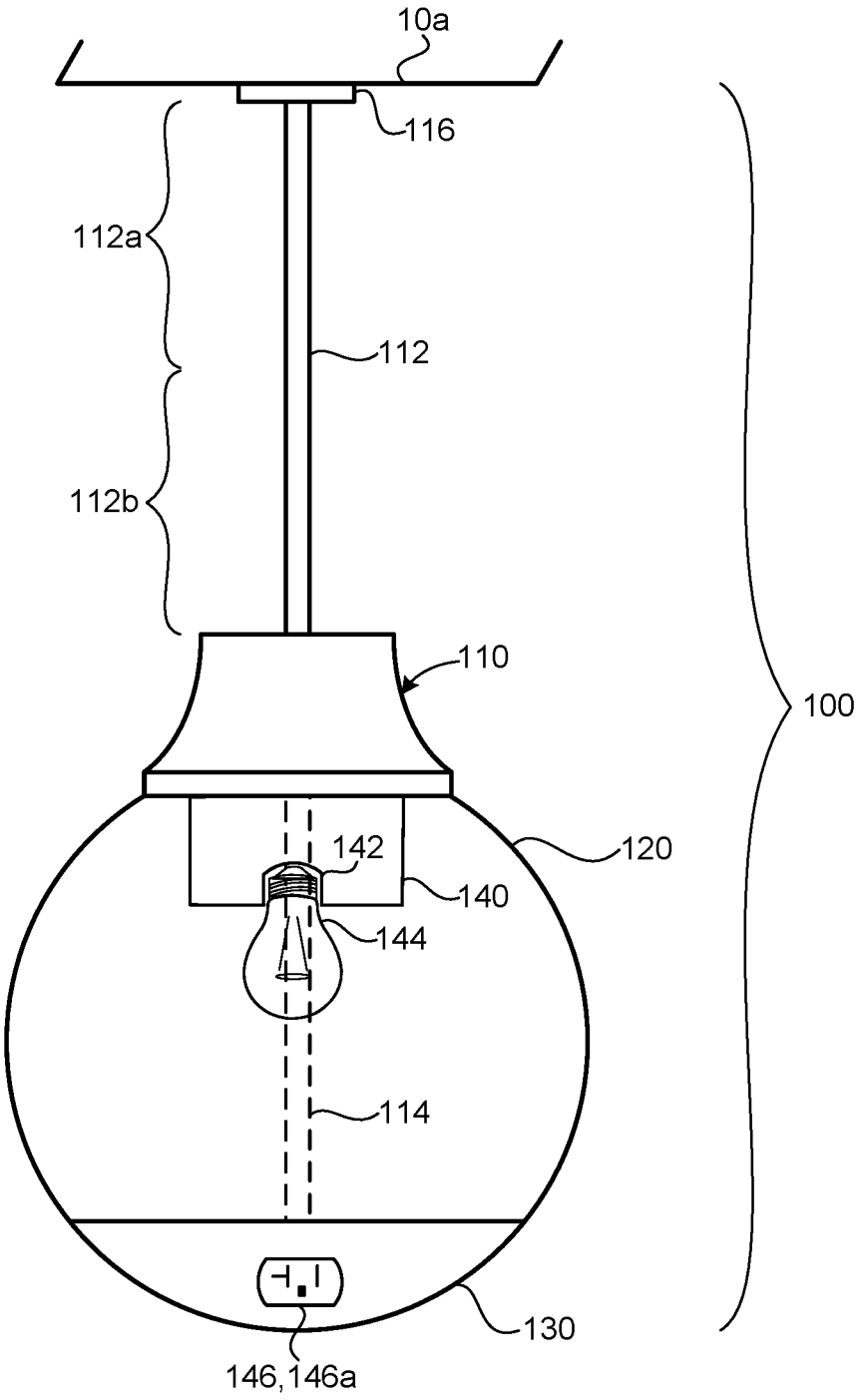
FIGS. 3A and 3B are side views of an exemplary light fixture.
Figure 3B:
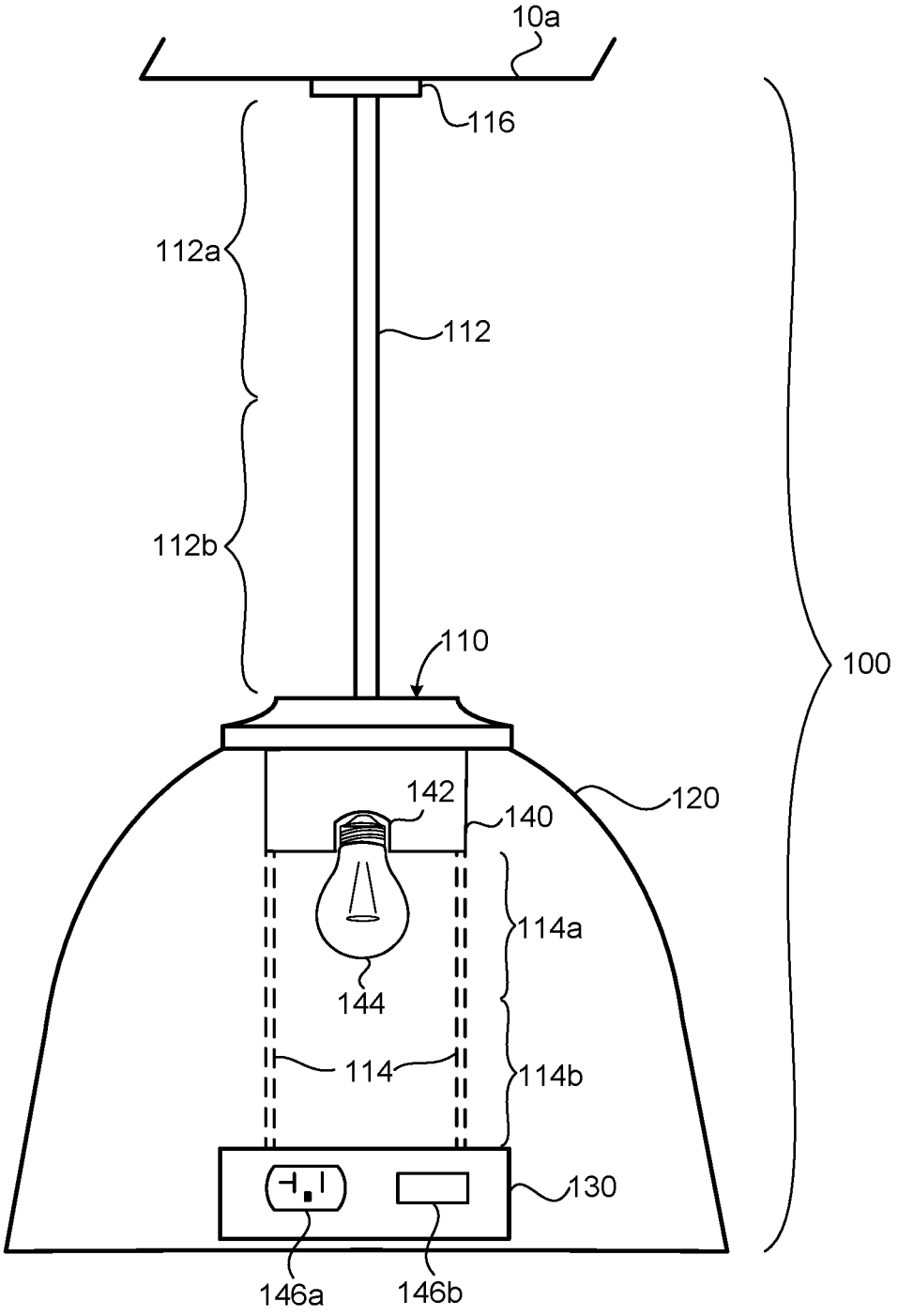

Referring to FIGS. 2A and 2B, in some implementations, the receiver 140 includes at least one socket 142 for receiving at least one light emitter 144. As shown, the light fixture 100 includes two light emitters 144. In some examples, the fixture body 110 includes a pull-down mechanism 118 having first and second portions. The pull-down mechanism 118 is connected to the receiver 140 (as shown) or the mounting stem 112 and allows the frame 130 to move in a vertical direction within the shroud 120 to allow for easier access to the power or communication receptacle 146.

In some implementations, the receiver 140 includes a power receptacle 146*a*, a communication receptacle 146*b* and at least one socket 142 for receiving at least one light emitter 144. A pull-down mechanism 118 may be connected to the mounting stem 112 and allows the receiver 140 to move in a vertical direction within the shroud 120 to allow for easier access to the power or communication receptacle 146. In some examples, as shown, the pull-down mechanism 118 has a first portion 118*a* connected to the receiver 140 and a second portion 118*b* connected to the frame 130. The second portion 118*b* moves with respect to the first portion 118*a* between a closed or concealed position (FIG. 2A) concealing the power or communication receptacle 146 within the shroud 120 and an open position (FIG. 2B) allowing access to the power or communication receptacle 146. The first and second portions 118*a*, 118*b* of the pull-down mechanism 118 may be arranged for telescopic movement.

Examples of pull-down mechanisms 118 may include, but are not limited to, a ball screw, a scissor arrangement, or a spring load. A ball screw includes a threaded shaft that provides a helical track for a ball bearing acting as a precision screw. The ball screw acts as a linear actuator and translates rotational motion to linear motion allowing the second portion 118*b* of the pull-down mechanism 118*b* to linearly move in a vertical direction with respect to the shroud 120. As shown in the figures, the scissor arrangement includes two angled arms 119 having a pivoting elbow portion 117. In the closed position (FIG. 2A, the pivoting elbows 117 bend simultaneously and decreased the distance between the first portion 118*a* of the pull-down mechanism 118 and the receiver 140. In the open position (FIG. B), the pivoting elbows 117 extend simultaneously and increase the distance between the first portion 118*a* of the pull-down mechanism 118 and the receiver 140 allowing easier access to the power or communication receptacles 146.

Referring to FIGS. 3A-5C, in some implementations, the light fixture 100 has a base 116, a fixture body 110, a shroud 120, a power or communication receptacle 146, and a receptacle cover 160. The fixture body 110 is disposed on the base 116 and is configured to support a light emitter 144. The fixture body 110 includes a frame 130 for supporting the power and or communication receptacles 146. The frame 130 is connected to a frame stem 114 having a first end 114*a* attached to the receiver 140 and a second end 114*b* attached to the frame 130.

Figure 4C:
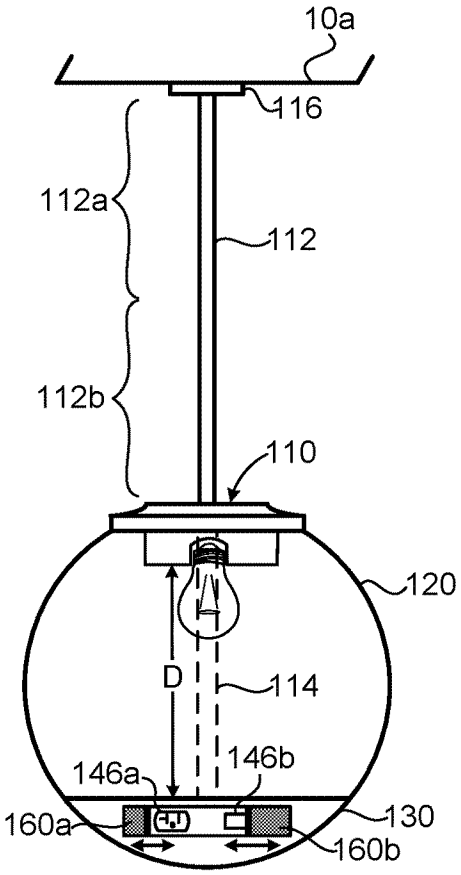
FIG. 4C is a side view of the light fixture of FIG. 4A in an open position having a sliding door.
Figure 4B:
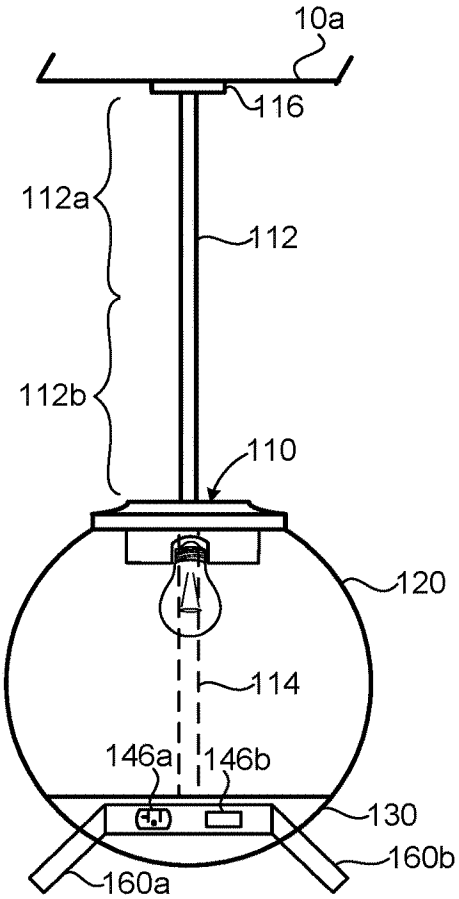
FIG. 4B is a side view of the light fixture of FIG. 4A in an open position having a pivoting door.
Figure 4A:
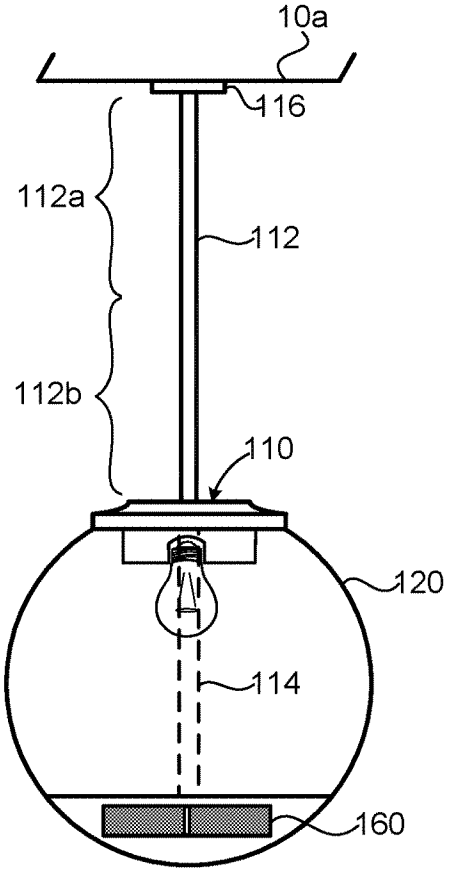
FIG. 4A is a side view of an exemplary light fixture having a receptacle cover.

Referring to FIGS. 4A-4C, in some examples, the shroud 120 is disposed on the fixture body 110 and is arranged to at least partially conceal the light emitter 144. In addition, the power or communication receptacle 146 is disposed on the fixture body 110 away from the base 116. The receptacle cover 160 is disposed on the fixture body 110 and moves between a closed position concealing the power or communication receptacle 146 and an open position allowing access to the power or communication receptacle 146.

In some examples, as shown in FIG. 4B, the receptacle cover 160 is a pivoting door mechanism. The pivoting door mechanism 160 may have a pivoting door 160*a*, 160*b* for access to the power or communication receptacle 146. In some instances, the light fixture 100 includes more than one power receptacle 146*a* and/or more than one communication receptacle 146*b*. The receptacle cover 160 may include a separate door 160*a*, 160*b* for each power or communication receptacle 146.

In some examples, as shown in FIG. 4C, the receptacle cover 160 is a pair of sliding doors 160*a*, 160*b* that slide horizontally to provide access to the power and or communication receptacles 146*a*, 146*b*. The sliding doors 160*a*, 160*b* may slide vertically in an up or down position.

Figure 5C:
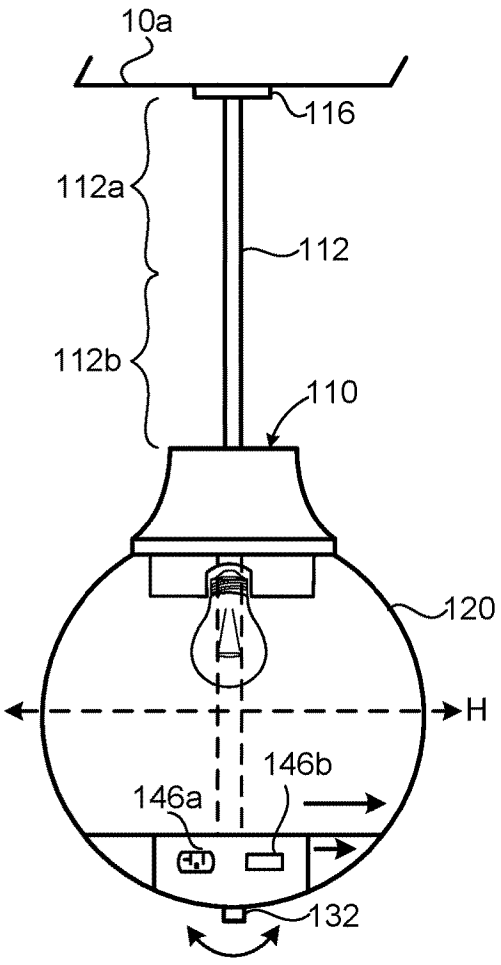
FIG. 5C is a side view of the light fixture of FIG. 5A in an open position twisting with respect to the fixture body.
Figure 5B:
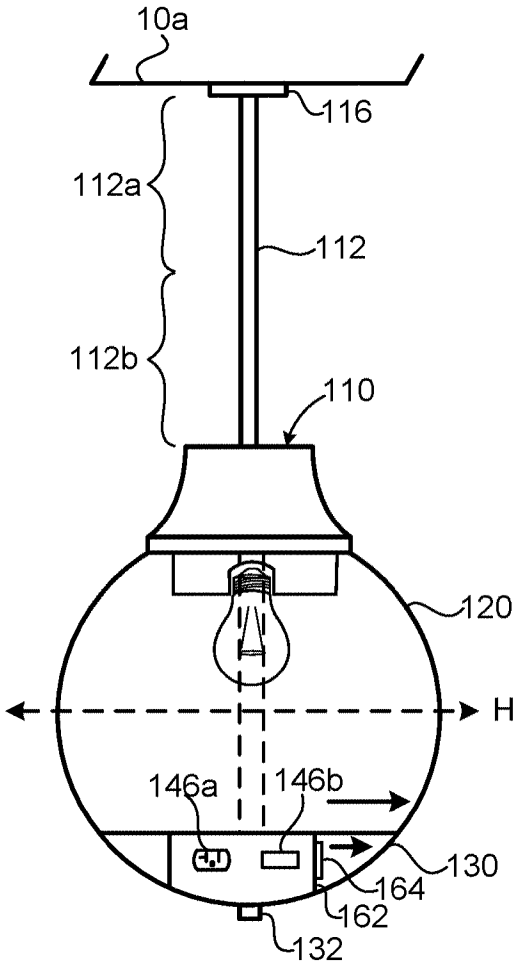
FIG. 5B is a side view of the light fixture of FIG. 5A in an open position having a sliding door.
Figure 5A:
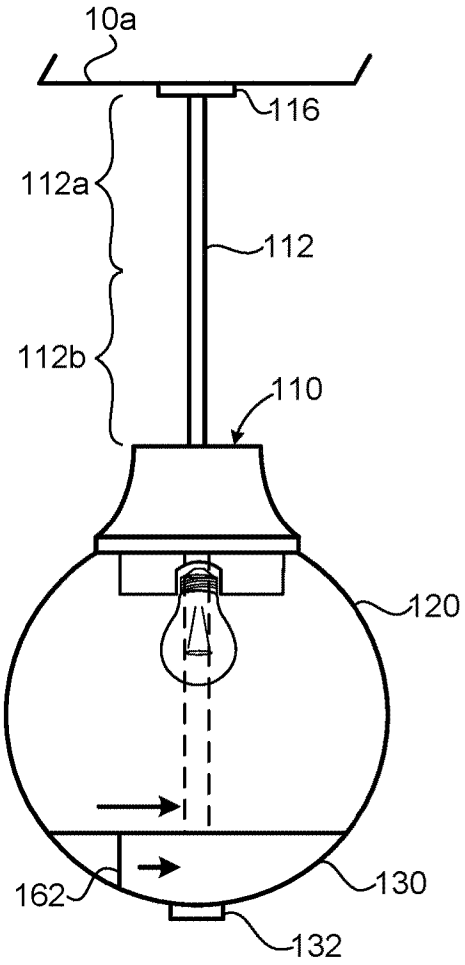
FIG. 5A is a side view of an exemplary light fixture having a receptacle cover.

Referring to FIGS. 5A-5C, in some implementations, the frame 130 includes a sliding door 162 sliding in a horizontal direction along a horizontal axis H defined by the fixture body 110. The sliding door 162 may have a handle 164 to slide the sliding 162 door and expose the receptacles 146, see FIG. 5B. In some examples, the fixture body 110 includes a knob 132. The knob 132 may be twisted to open the sliding door 160*b*, see FIG. 5C.

In some examples, the fixture body 110 further includes a mounting stem 112, a receiver 140, and a frame 130. The receiver 140 is disposed on the mounting stem 112 and defines a socket 142 for electric connection of the light emitter 144. The frame 130 is connected to the receiver 140 and supports the power or communication receptacle 146 spaced away from the socket 142 by a threshold distance D. The threshold distance D may be at least three inches.

Figure 6B:
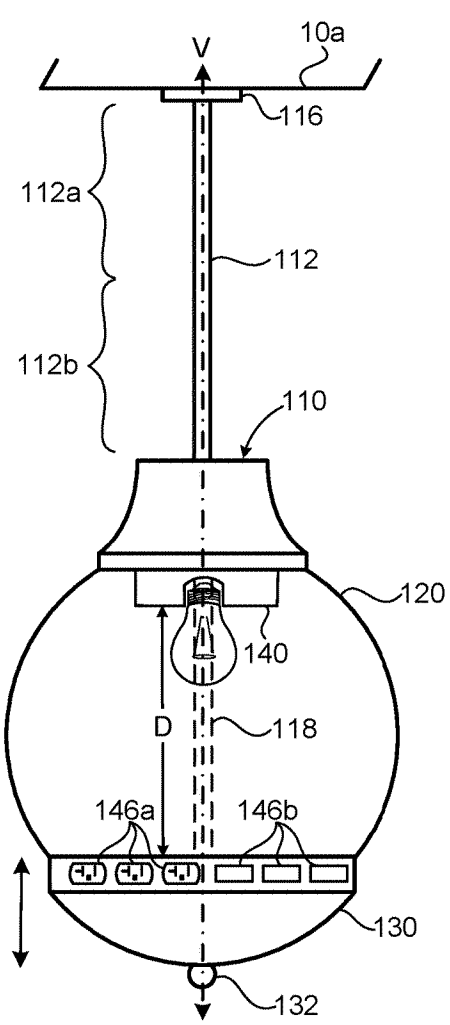
FIG. 6B is a side view of the light fixture of FIG. 6A in an open position.
Figure 6A:
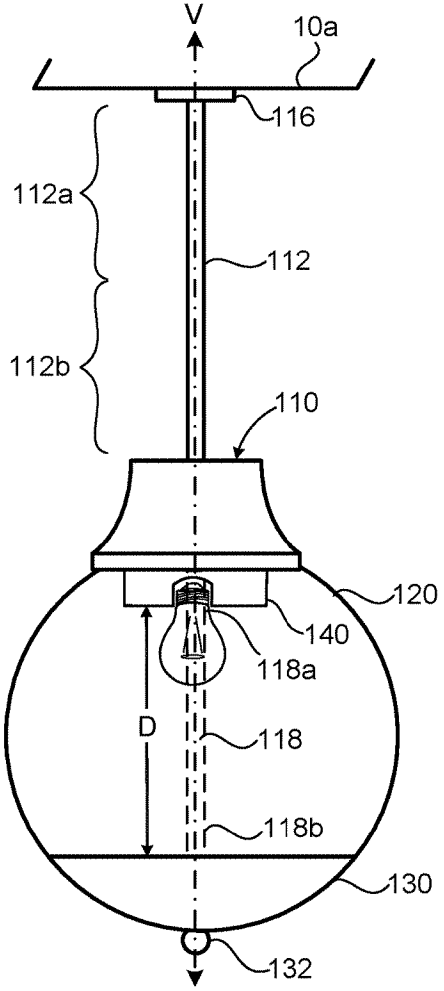
FIG. 6A is a side view of an exemplary light fixture in a closed position.

Referring to FIGS. 6A and 6B, in some implementations, the fixture body 110 includes a pull-down mechanism 118 having a knob 132. The pull-down mechanism 118 has first and second portions 118*a*, 118*b*, where the first portion 118*a* is connected to the receiver 140 and the second portion 118*b* is connected to the frame 130. In some examples, a person may grab the knob 132 and pull the frame 130 away from the shroud 120 exposing the power and communication receptacles 146, 146*a*-*b*. The person may push the knob 132 towards the shroud 120 therefore hiding the power or communication receptacle 146. In some examples, the pull-down mechanism 118 may be a ball screw having first and second portions 118*a*, 118*b*. The first portion 118*a* of the ball screw is connected to the receiver 140 and the second portion 118*b* of the ball screw is connected to the frame 130. The frame 130 may rotate with respect to the shroud 120 about a vertical axis V defined by the fixture body 110. In addition, the frame 130 may include more than one communication receptacle 146*b*.

Figure 7C:
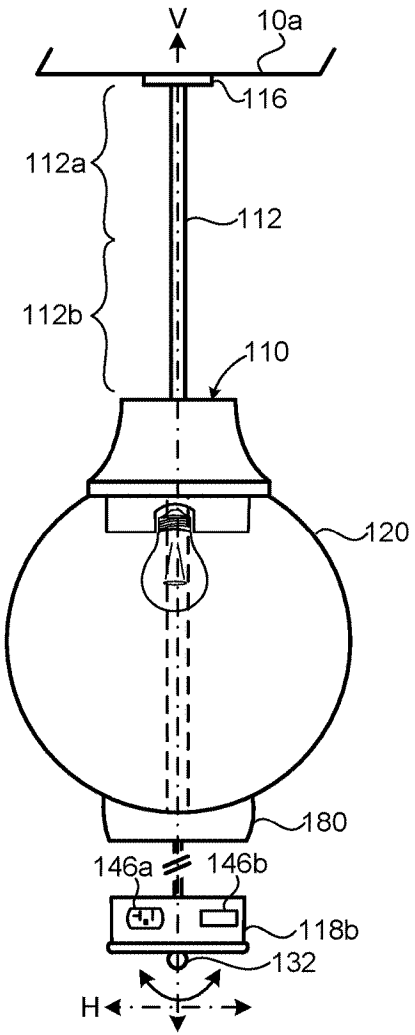
FIG. 7C is a side views of the light fixture of FIG. 7A in an open position moving in a twisting motion.
Figure 7B:
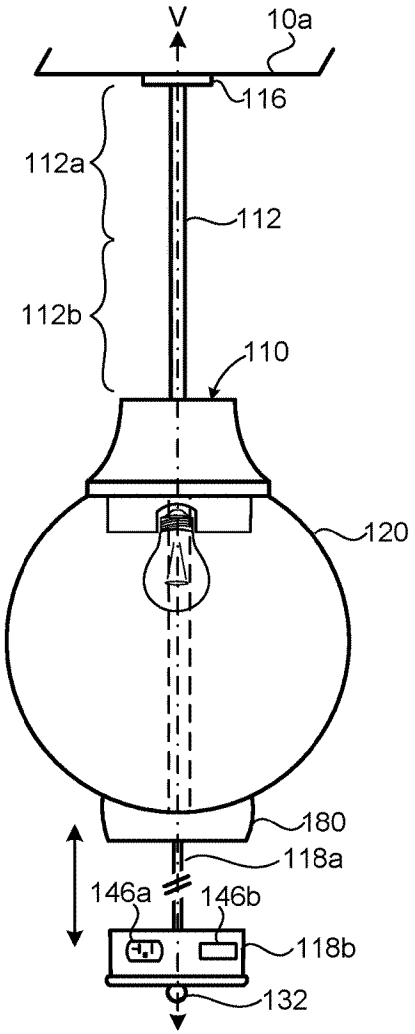
FIG. 7B is a side view of the light fixture of FIG. 7A in an open position moving in a vertical motion.
Figure 7A:
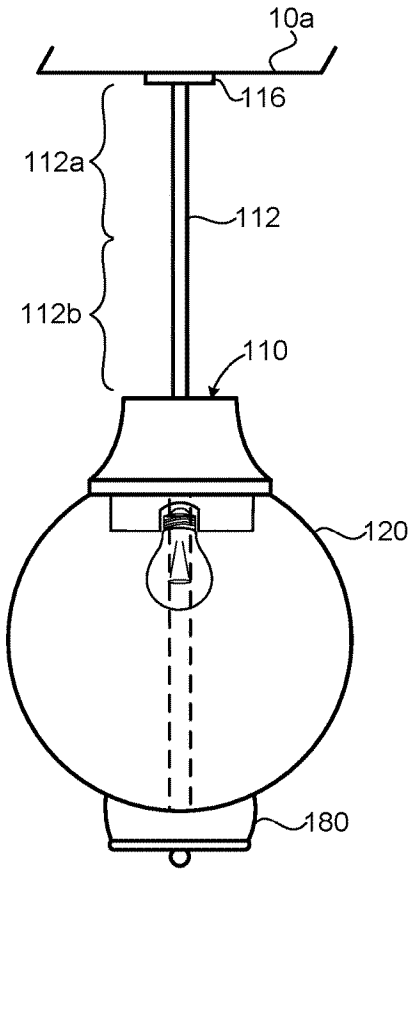
FIG. 7A is a side view of an exemplary light fixture having a connector body.

Referring to FIGS. 7A-7C, in some implementations, the light fixture 100 includes a connector body 180 movably disposed on the fixture body 110 and supporting the power or communication receptacle 146. The connector body 180 moves between a closed position (FIG. 7A) where the power or communication receptacle 146 is concealed by the fixture body 110 or shroud 120 and an open position (FIGS. 7B and 7C) allowing access to the power or communication receptacle 146. A pull-down mechanism 118 may also be included in the light fixture 100. The pull-down mechanism 118 has a first portion 118*a* connected to the connector body 180 and a second portion 118*b* moving with respect to the first portion 118*a* between a closed position concealing the power or communication receptacle 146 and an open position allowing access to the power or communication receptacle 146. In some examples, the second portion 118*b* includes a knob 132 for pulling or twisting the second portion 118*b* away from the connector body 180. The knob 132 may fold inside the second portion 118*b*. Additionally, the second portion 118*b* may extend to reach a flat surface (e.g., a tabletop) and lay flat on the surface. Referring to FIG. 7B, in some examples, the knob 132 is used for pulling the second portion 118*b* away from the first portion 118*a* to allow access to the receptacles 146. The second portion 118*b* may move along a vertical axis V defined by the fixture body 110.

Referring to FIG. 7C, in some examples, the connector body 180 rotates using the knob 132 with respect to the shroud 120 about the vertical axis V defined by the fixture body 110 to allow access to the power or communication receptacle 146. The connector body 180 may rotate with respect to the shroud 120 about a horizontal axis H defined by the fixture body 110 to allow access to the power or communication receptacle 146.

Figure 8B:
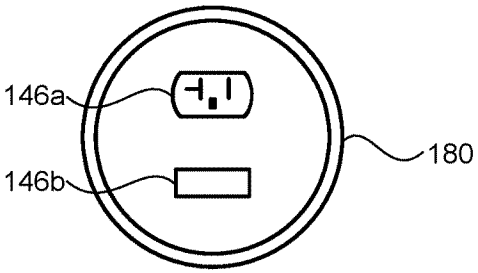
FIG. 8B is a bottom view of the connector body of FIG. 8A.
Figure 8A:
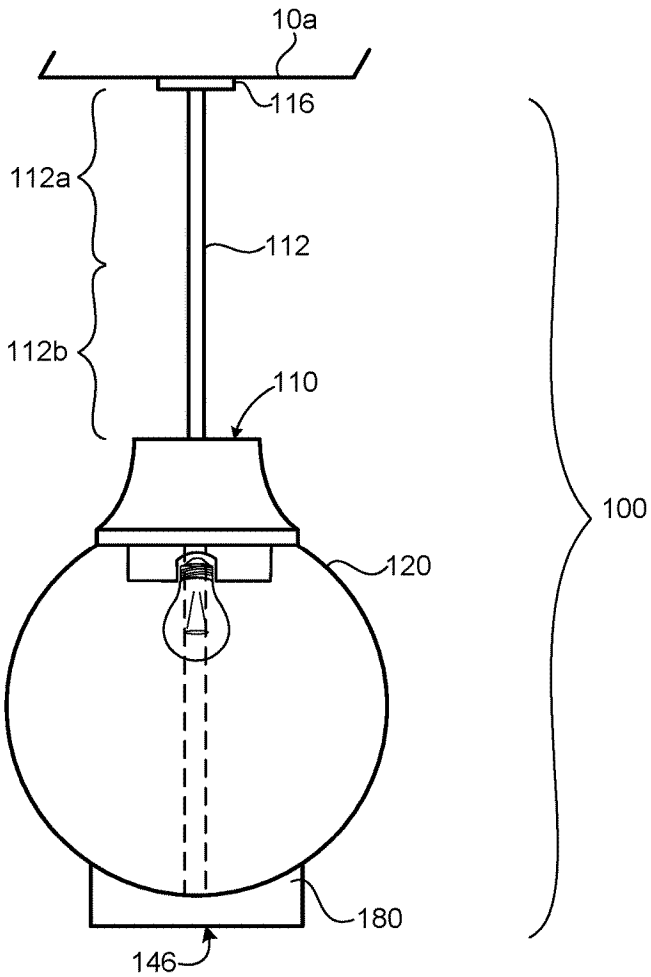
FIG. 8A is a side view of an exemplary light fixture with a connector body concealing the power and or communication receptacles.

Referring to FIGS. 8A and 8B, in some implementations, the fixture body 110 includes a connector body 180 that supports the power or communication receptacle 146 when viewed from the bottom (FIG. 8B). This arrangement allows quick and easy access to the power or communication receptacle 146, while partially concealing the power or communication receptacle 146 from ordinary view (e.g., from a side view).

Referring to FIGS. 9A-11B, in some implementations, the light fixture 100 includes a mount 116, a stem 112, a power or communication receptacle 146, at least one arm 113, and a light receiver 142 (e.g., socket). The stem 112 has a first end 112*a* attached to the mount 116 and extends away from the mount 116 to a second end 112*b*. The power or communication receptacle 146 is disposed on the second end 112*b* of the stem 112. The at least one arm 113 has a first end 113*a* attached to the stem 112 and extends away from the stem 112 to a second end 113*b*. In addition, the light receiver 142 may be disposed on the second end 113*b* of at least one arm 113 for receiving a light emitter 144 (e.g., an incandescent light bulb, a fluorescent lamp or tube, a compact fluorescent lamp (CFL), an LED lamp). The power or communication receptacle 146 may be releasably detachable from the fixture body 110.

Figure 9B:
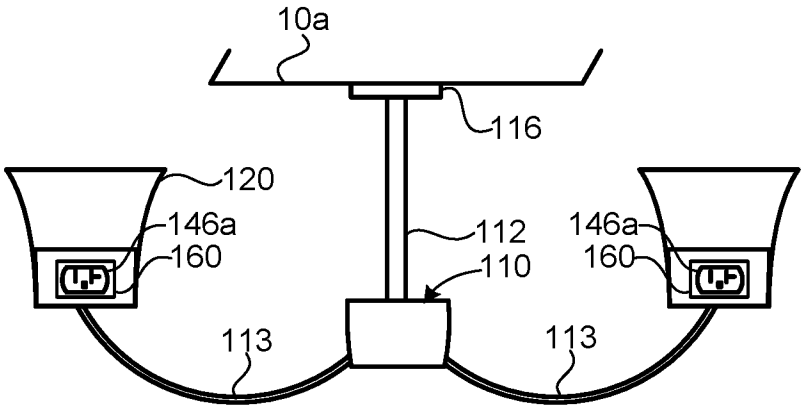
FIGS. 9A and 9B are side views of exemplary light fixtures.
Figure 9A:
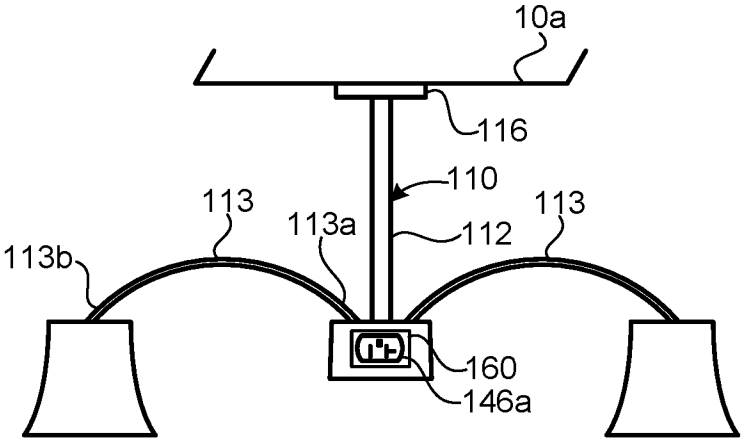

The light fixture 100 may include a receptacle cover 160 disposed on the second end 112*b* of the stem 112 (FIG. 9A). The receptacle cover 160 moves between a closed position concealing the power or communication receptacle 146 and an open position allowing access to the power or communication receptacle 146. The receptacle cover 160 may include a pivoting door or a sliding door similar to the sliding and pivoting doors 160 of FIGS. 4A-4C. In some examples, where the power or communication receptacle 146 is disposed on the second end 113*b* of the arm 113, the receptacle cover 160 may be disposed on the second end 113*b* of the arm 113 to cover the receptacle 146.

Figure 10B:
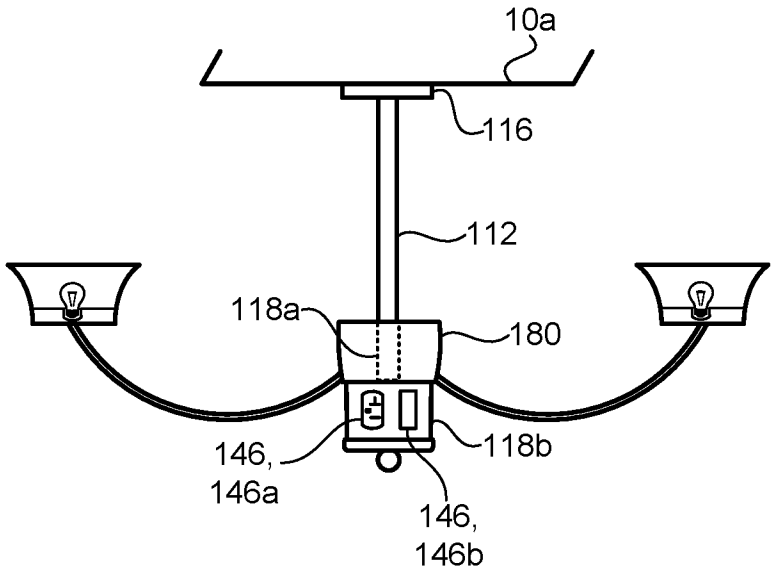
FIG. 10B is a side view of the light fixture of FIG. 10A in an open position.
Figure 10A:
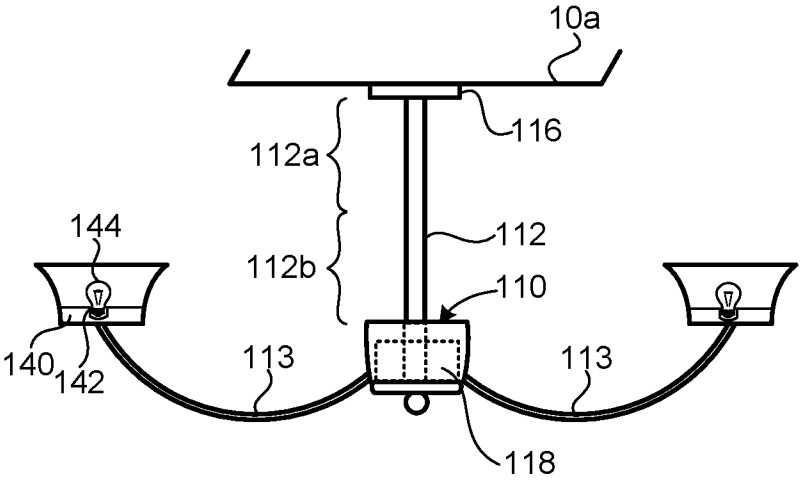
FIG. 10A is a side view of an exemplary light fixture in a closed position.

Referring to FIGS. 10A and 10B, in some implementation, the light fixture 100 includes a connector body 180 movably disposed on the second end 112*b* of the stem 112. The connector body 180 supports the power or communication receptacle 146 and moves between a closed position (FIG. 10A) where the power or communication receptacle 146 is concealed by the fixture body 110 or shroud 120 and an open position (FIG. 10B) which allows access to the power or communication receptacle 146.

In some examples, the light fixture 100 includes a pull-down mechanism 118. The pull-down mechanism 118 includes a first portion 118*a* connected to the connector body 180 and a second portion 118*b* moving with respect to the first portion 118*a* between a closed position concealing the power or communication receptacle 146 and an open position allowing access to the power or communication receptacle 146. The connector body 180 may rotate with respect to the shroud 120 about a vertical axis defined by the stem to allow access to the power or communication receptacle 146. In some examples, the connector body 180 rotates with respect to the shroud 120 or fixture body 110 about a horizontal axis defined by the stem 112 to allow access to the power or communication receptacle 146. The first and second portions 118*a*, 118*b* of the pull-down mechanism 118 may be arranged for telescopic movement. Additionally or alternatively, the pull-down mechanism 118 may include a ball screw as previously described with respect to FIGS. 7A-7C. In some examples, the connector body 180 supports the power or communication receptacle 146 arranged to face downward (e.g., when viewed from the bottom similar to FIG. 8B).

Figure 11:
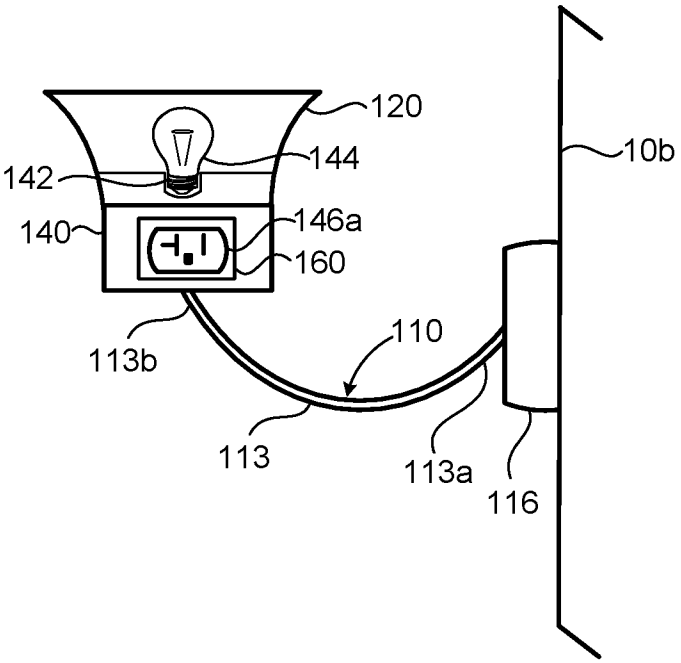
FIG. 11 is a side view of an exemplary light fixture.

Referring to FIG. 11, the light fixture 100 may include a base or mount 116, a power or communication receptacle 146, at least one arm 113, and a light receiver 142 (e.g., socket). In some examples, the light receiver 142 is disposed on a distal receiver 140 attached to the arm 113. The arm 113 has a first end 113*a* attached to the mount 116 and extends away from the mount 116 to a second end 113*b* that supports the distal receiver 140. The power or communication receptacle 146 may disposed on the second end 113*b* of the arm 113 or on the distal receiver 140. In addition, the light receiver 142 may be disposed on the second end 113*b* of the arm 113 for receiving a light emitter 144 (e.g., an incandescent light bulb, a fluorescent lamp or tube, a compact fluorescent lamp (CFL), an LED lamp). The power or communication receptacle 146 may be releasably detachable from the fixture body 110. In some examples, the light fixture 100 further includes a receptacle cover 160 disposed on the receiver 140 disposed on the second end 113*b* of the arm 113. The receptacle cover 160 moves between a closed position concealing the power or communication receptacle 146 and an open position allowing access to the power or communication receptacle 146. The receptacle cover 160 may be a pivoting door or a sliding door.

Figure 12:
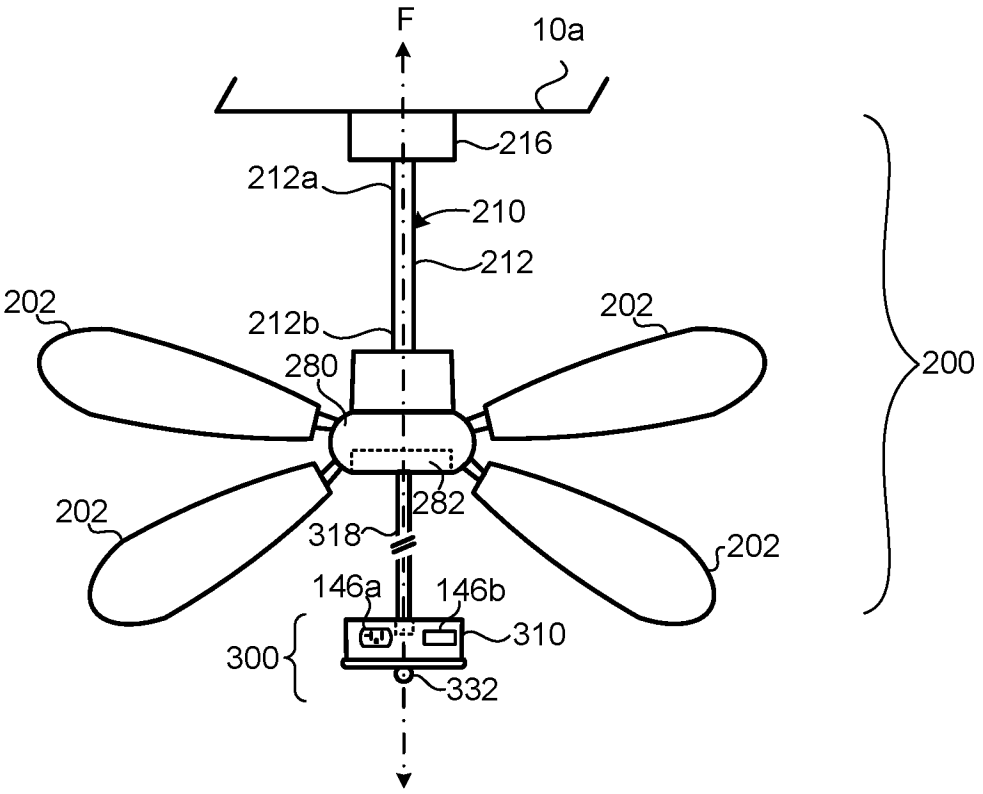
FIG. 12 is a side view of a fan fixture.

Referring to FIG. 12, in some examples, a fan fixture 200 has a plurality of blades 202 attached to a fan fixture body 210. The blades 202 rotate about a vertical axis F defined by the fan fixture body 210. The fan body 210 includes a mounting stem 212 having a first end 212*a* connecting to a base 216, which in turn connects to a ceiling 10*a*. A second end 212*b* of the mounting stem 212 connects to a fan connector body 280. The fan connector body 280 includes a receptacle 282 for releasably receiving an attachment. In some examples, an electric connector module 300 may be releasably attached to the fan fixture 200 or to a light fixture.

Referring to FIGS. 13A-15B, in some implementations, the module 300 includes a module body 310, a power receptacle 146*a* or a communication receptacle 146*b* or both. The module 300 also includes and electric connector 330 to electrically connect to the fan fixture body 210 through the fan receptacle 282. The power or communication receptacle 146 is disposed on the module body 310. An electric connector 330 may be disposed on the module body 310 and arranged to releasably electrically connect the power or communication receptacle 146 to a power or communication line of the fan fixture 200.

Figure 13B:
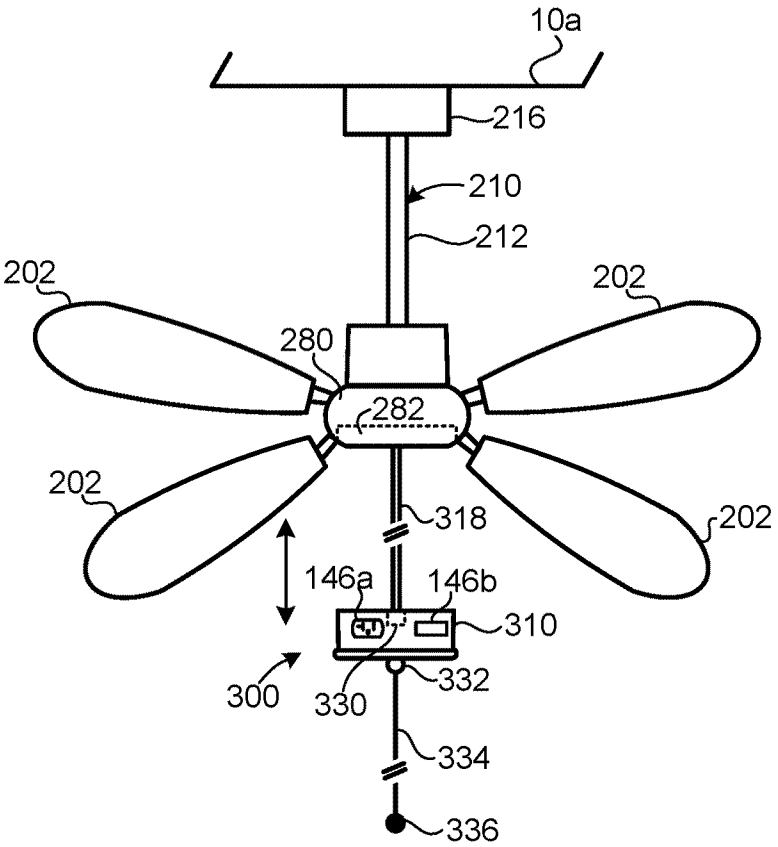
FIG. 13B is a side view of the exemplary electric connector module for a light or fan fixture in an open position.
Figure 13A:
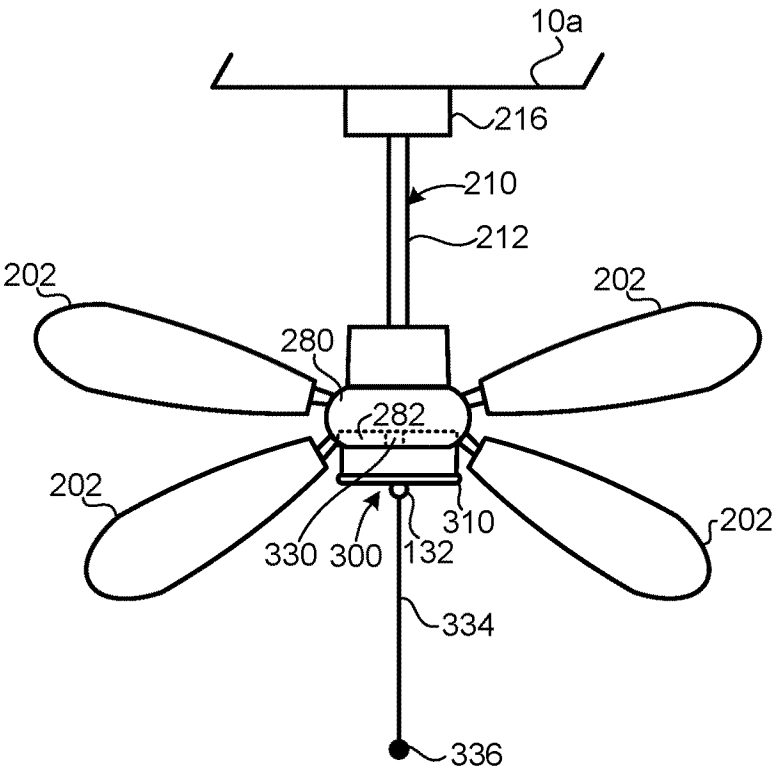
FIG. 13A is a side view of an exemplary electric connector module for a light or fan fixture in a closed position.
Figure 14B:
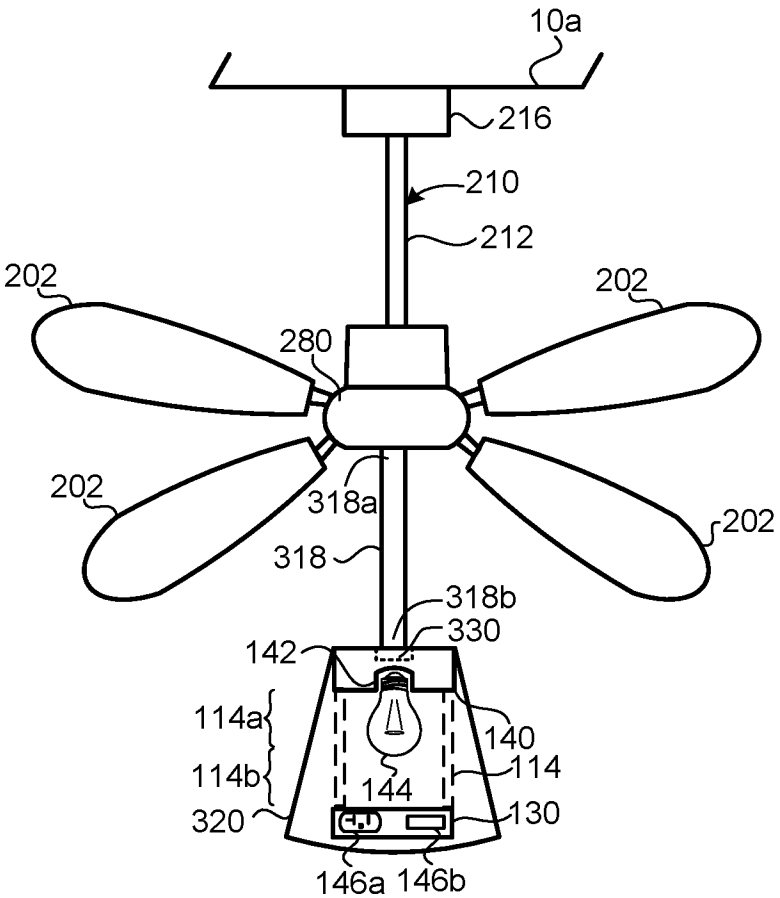
FIG. 14B is a side view of an exemplary electric connector module for a light or fan fixture in an extended position.

Most ceiling fan fixtures 300 are attached to high ceilings 10*a* to avoid injury if a user attempts to touch the blades 202. Therefore, it might be difficult to reach the module body 310. In some examples, the module body 310 includes a knob 332 attached to a hanging cord 334, which has a handle 336. A user may pull on the handle 336 to extend the module 300 away from the fan fixture 200, from a retracted position to an extended position, allowing the user to reach the power and communication receptacles 146. If the user pulls the handle 336 a second time, then the module 300 may return to its retracted position (FIG. 13B). In some examples, the module 300 may include a remote control (not shown) for controlling powered movement of the module 300 from its retracted position (FIGS. 13A, 14A, 15A) to its extended position (FIGS. 13B, 14B, 15B).

The module mounting stem 318 may include a pull-down mechanism 318. The pull-down mechanism 318 has a first portion 318*a* and a second portion 318*b* (FIGS. 14B and 15B). The first portion 318*a* connects to the fan fixture 200 and the second portion 318*b* moves with respect to the first portion 318*a* between a retracted position (FIGS. 13A, 14A, 15A) and an extended position (FIGS. 13B, 14B, 15B). In some examples, when in the retracted position, the power or communication receptacle 146 is concealed (FIG. 13A). The extended position allows access to the power or communication receptacle 146. The first and second portions 318*a*, 318*b* of the pull-down mechanism 318 may be arranged for telescopic movement.

In some implementations, the module body 300 supports a light emitter 144 and includes a socket 142 for electric connection of the light emitter 144. The module body 310 may include a mounting stem 318 and a receiver 140. The mounting stem 318 has first and second end portions 318*a*, 318*b*, where the first end portion 318*a* is configured to mount onto a supporting surface (e.g., connector body 280) of the light or fan fixture 200. The receiver 140 is disposed on the second end portion 318*b* of the mounting stem 318 and supports a socket 142 and the power and/or communication receptacle 146. In some examples, the receiver 140 is concealed by a shroud 320. The receiver 140 may be disposed in a location within an interior area of the shroud 320.

In some implementations, a shroud 320 is disposed on the module body 310 and arranged to at least partially conceal a light emitter 144 supported by the module body 310. The module body 310 may include a socket 142 for electric connection of the light emitter 144.

Figure 14A:
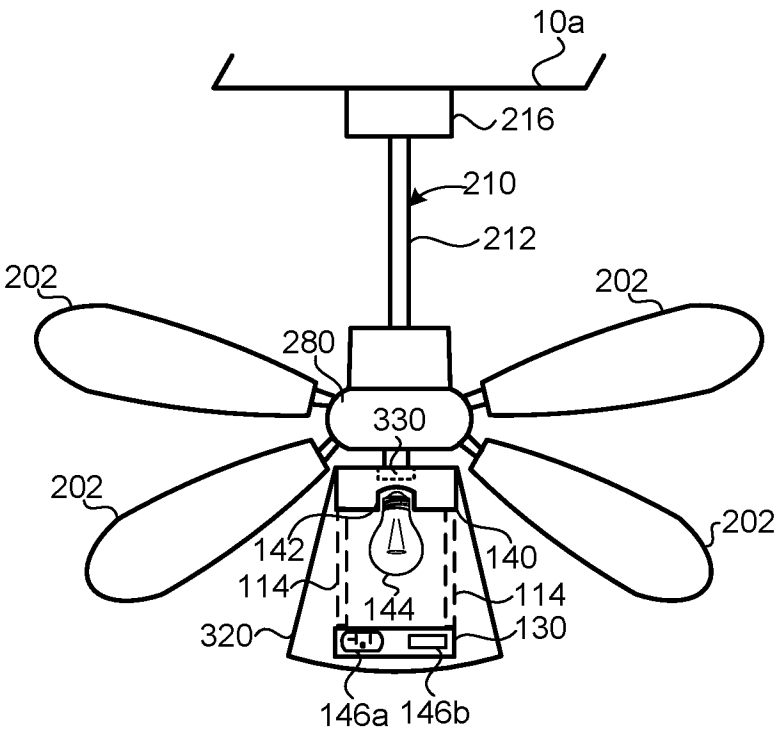
FIG. 14A is a side view of an exemplary electric connector module for a light or fan fixture in a retracted position.
Figure 15B:
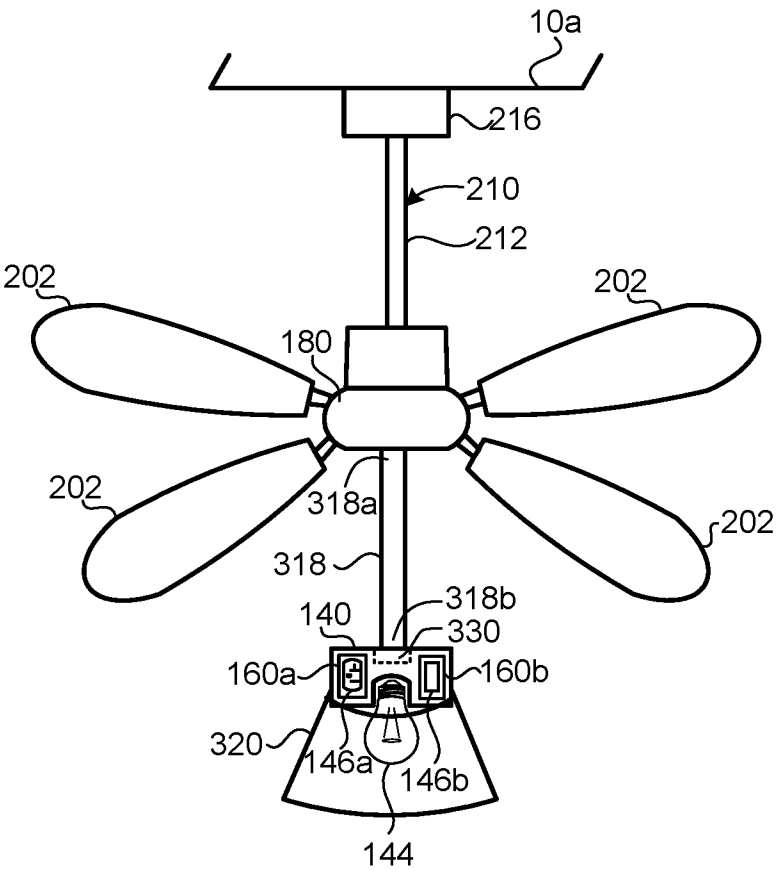
FIG. 15B is a side view of the exemplary electric connector module for a light or fan fixture in an extended position.

Referring to FIGS. 14A and 14B, in some examples, the module 300 includes a receiver 140 and a frame 130. The receiver 140 includes a socket 142 for electric connection of the light emitter 144. The frame 130 supports the power and/or communication receptacles 146 and is connected to a frame stem 114 having a first end 114*a* attached to the receiver 140 and a second end 114*b* attached to the frame 130.

Figure 15A:
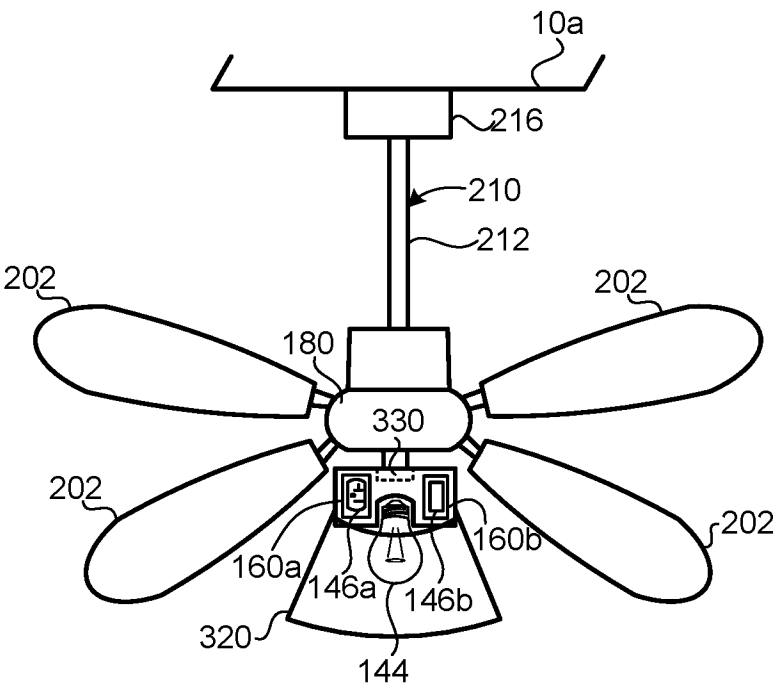
FIG. 15A is a side view of an exemplary electric connector module for a light or fan fixture in a retracted position.

Referring to FIGS. 15A and 15B, the receiver 140 is disposed outside of the shroud 320, allowing access to the power and communication receptacles 146 without getting close to the light emitter 144. Therefore, a receptacle cover 160 may be disposed on the second end portion 318*b* of the stem 318 to hide the power and communication receptacles 146 from view. The receptacle cover 160 moves between a closed position to conceal the power or communication receptacle 146 and an open position to allow access to the power or communication receptacle 146. The receptacle cover 160 may include a pivoting door or a sliding door (e.g., as shown in FIGS. 4A-4C).

A number of implementations have been described. Nevertheless, it will be understood that various modifications may be made without departing from the spirit and scope of the disclosure. Accordingly, other implementations are within the scope of the following claims.

What is claimed is:

1. A light fixture comprising:

a fixture body comprising:

a mount configured to mount onto a mounting surface and suspend the fixture body from the mounting surface;

a mounting stem having first and second ends, the first end of the mounting stem connected to the mount;

a receiver disposed on the second end of the mounting stem below the first end with respect to the mounting surface; and a socket disposed on the receiver for electrically receiving a light emitter, the received light emitter extending downward and away from the receiver with respect to the mounting surface;

a frame stem having a first end attached to the receiver and extending downward and away from the receiver past the received light emitter to a second end, the second end of the frame stem located below the received light emitter with respect to the mounting surface;

a frame attached to the second end of the frame stem and spaced downward and away from the socket with respect to the mounting surface by a threshold distance; and a power receptacle and/or a communication receptacle disposed on the frame in a location below the fixture body and the received light emitter with respect to the mounting surface.

2. The light fixture of claim 1, wherein the power receptacle and/or the communication receptacle is positioned between about 1 inch and about 3 inches below the light emitter with respect to the mounting surface.

3. The light fixture of claim 1, further comprising a receptacle cover disposed on the frame, the receptacle cover moving between a closed position concealing the power receptacle and/or the communication receptacle and an open position allowing access to the power receptacle and/or the communication receptacle.

4. The light fixture of claim 3, wherein the receptacle cover comprises a pivoting door or a sliding door.

5. The light fixture of claim 1, further comprising a pull-down mechanism having a first portion connected to the mounting stem or the receiver and a second portion moving with respect to the first portion between a stowed position and a deployed position.

6. The light fixture of claim 5, wherein the pull-down mechanism conceals the power receptacle and/or the communication receptacle while in the stowed position and allows access to the power receptacle and/or the communication receptacle while in the deployed position.

7. The light fixture of claim 6, wherein the first and second portions of the pull-down mechanism are arranged for telescopic movement.

8. The light fixture of claim 6, wherein the pull-down mechanism comprises pivotally connected arms.

9. The light fixture of claim 1, wherein the fixture body, the frame, and the power receptacle and/or the communication receptacle are arranged in a substantially vertical arrangement with respect to the mounting surface, wherein the power receptacle and/or a communication receptacle is/are accessible below the fixture body and the received light emitter with respect to the mounting surface.

* * * * *